US007770567B1

(12) United States Patent
Yehle

(10) Patent No.: US 7,770,567 B1
(45) Date of Patent: Aug. 10, 2010

(54) SAFETY TRIGGER FOR A CROSSBOW

(75) Inventor: Craig T. Yehle, Junction City, OR (US)

(73) Assignee: Extreme Technologies, Inc., Eugene, OR (US)

( * ) Notice: Subject to any disclaimer, the term of this patent is extended or adjusted under 35 U.S.C. 154(b) by 313 days.

(21) Appl. No.: 11/763,155

(22) Filed: Jun. 14, 2007

(51) Int. Cl.
*F41B 5/12* (2006.01)

(52) U.S. Cl. ..... 124/25; 124/40

(58) Field of Classification Search ..... 124/25, 124/40

See application file for complete search history.

(56) References Cited

U.S. PATENT DOCUMENTS 5,085,200 A 2/1992 Horton-Corcoran et al.
5,598,829 A 2/1997 Bednar
5,649,520 A * 7/1997 Bednar ..... 124/25
5,884,614 A 3/1999 Darlington et al.
6,205,990 B1 3/2001 Adkins
6,736,123 B1 5/2004 Summers et al.
6,802,304 B1 10/2004 Chang
2006/0144380 A1 7/2006 Kempf

* cited by examiner

*Primary Examiner*—John Ricci
(74) *Attorney, Agent, or Firm*—David S. Alavi

(57) ABSTRACT

A trigger assembly for a crossbow comprises a caliper, a trigger mechanism, a safety mechanism, and a bolt sensor. The caliper retains or releases a bowstring. The trigger mechanism holds the caliper against its bias to retain the bowstring, or releases the caliper to release the bowstring and fire the crossbow. The safety mechanism in a safety-on arrangement blocks the trigger mechanism or in a safety-off arrangement enables movement of the trigger mechanism. The bolt sensor biases the safety mechanism toward its safety-on arrangement when no bolt is present, or is held against its bias by a bolt to enable movement of the safety mechanism into its safety-off arrangement.

21 Claims, 7 Drawing Sheets

SAFETY TRIGGER FOR A CROSSBOW

BACKGROUND

The field of the present invention relates to crossbows. In particular, a safety trigger for a crossbow is disclosed herein.

A wide variety of trigger mechanisms are available for crossbows. Some of these are described in:

U.S. Pat. No. 5,598,829 entitled "Crossbow dry fire prevention device" issued Feb. 4, 1997 to Bednar;

U.S. Pat. No. 5,884,614 entitled "Crossbow with improved trigger mechanism" issued Mar. 23, 1999 to Darlington et al;

U.S. Pat. No. 6,205,990 entitled "Dry-fire prevention mechanism for crossbows" issued Mar. 27, 2001 to Adkins;

U.S. Pat. No. 6,736,123 entitled "Crossbow trigger" issued May 18, 2004 to Summers et al;

U.S. Pat. No. 6,802,304 entitled "Trigger assembly with a safety device for a crossbow" issued Oct. 12, 2004 to Chang; and U.S. Pat. Pub. No. 2006/0144380 entitled "Crossbow" published Jul. 6, 2006 in the name of Kempf.

SUMMARY

A trigger assembly for a crossbow comprises a caliper, a trigger mechanism, a safety mechanism, and a bolt sensor. The caliper is moveable between a firing position and a non-firing position, and is arranged in its non-firing position to retain a bowstring of the crossbow and arranged in its firing position to release the bowstring. The trigger mechanism is moveable between a firing arrangement and a non-firing arrangement. The trigger mechanism is arranged in its non-firing arrangement to hold the caliper in its non-firing position, and is arranged in its firing arrangement to enable the caliper to move to its firing position. The safety mechanism is moveable between a safety-off arrangement and a safety-on arrangement. The safety mechanism is arranged in its safety-on arrangement so as to block movement of the trigger mechanism into its firing arrangement, and is arranged in its safety-off arrangement so as to allow movement of the trigger mechanism into its firing arrangement. The bolt sensor is moveable between a bolt-present position and a bolt-absent position and is biased toward the bolt-absent position. The bolt sensor is arranged to remain in its bolt-absent position in response to its bias in the absence of a bolt loaded onto the crossbow and to be held in its bolt-present position against its bias by a bolt loaded onto the crossbow. The bolt sensor is arranged in its bolt-absent position to bias the safety mechanism toward its safety-on arrangement and is arranged in its bolt-present position to allow movement of the safety mechanism into its safety-off arrangement.

Objects and advantages pertaining to a trigger assembly for a crossbow may become apparent upon referring to the exemplary embodiments illustrated in the drawings and disclosed in the following written description and/or claims.

The embodiments shown in the Figures are exemplary, and should not be construed as limiting the scope of the present disclosure and/or appended claims.

DETAILED DESCRIPTION OF EMBODIMENTS

Figure 7:
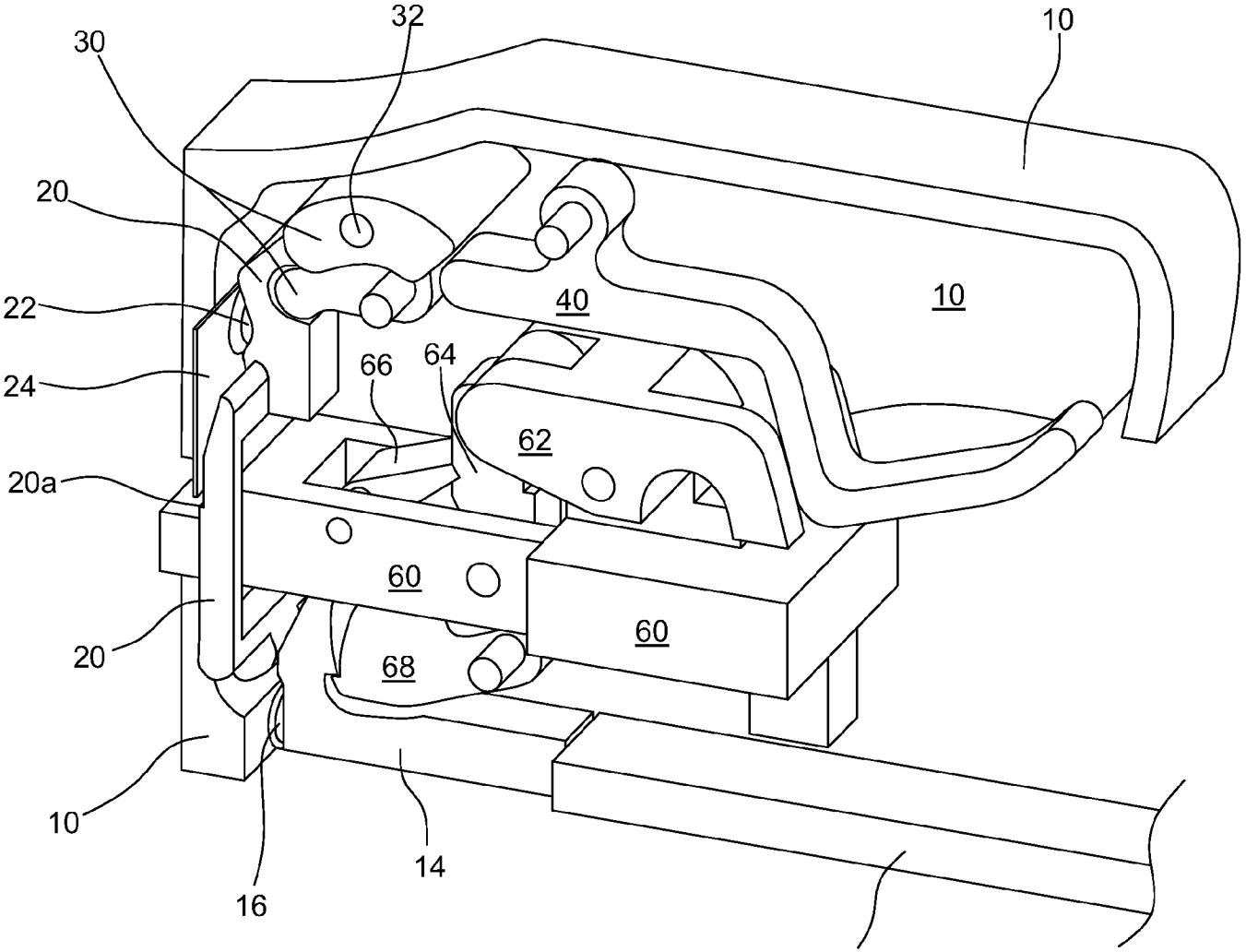
FIG. 7 is an enlarged schematic perspective view of the crossbow trigger assembly of FIG. 1 prior to placement of a bolt.

FIGS. 1-7 illustrate schematically a crossbow trigger assembly. The trigger assembly typically is mostly contained within a trigger housing 10. The trigger housing 10 can comprise an opening or cavity formed in the stock or rail of the crossbow (not shown) or can comprise a discrete housing 10 that is in turn secured to the stock or rail of the crossbow. Both arrangements are encompassed by the present disclosure. The crossbow is not shown and can be of any suitable type or configuration. In the Figures the trigger assembly is shown with one side of the housing 10 removed to reveal the trigger mechanism within. The entire trigger assembly is illustrated schematically in FIG. 1, while FIGS. 2-7 are enlarged schematic views of that portion of the trigger assembly contained within the trigger housing 10. The side views of FIGS. 2-6 illustrate schematically the firing sequence of the trigger assembly, and FIG. 7 is a perspective view corresponding to FIG. 2.

In FIGS. 2-6, the heavy arrows indicate the movements of the various parts of the trigger assembly. Single-headed arrows indicate that the designated motion is permitted in both directions but is directly biased in the direction of the single arrowhead. Directly biased means that a suitable bias mechanism (including for example a torsion spring, linear spring, some other resilient member, a weight, an actuator, or some other suitable biasing element or means) is arranged to act directly on that part. Many of the biasing elements are omitted from the Figures for clarity. Double-headed arrows indicate that the designated motion of the corresponding part is permitted in both directions and is not directly biased in either direction. However, the non-biased part can be indirectly biased by bias or movement of other adjacent parts.

Figure 2:
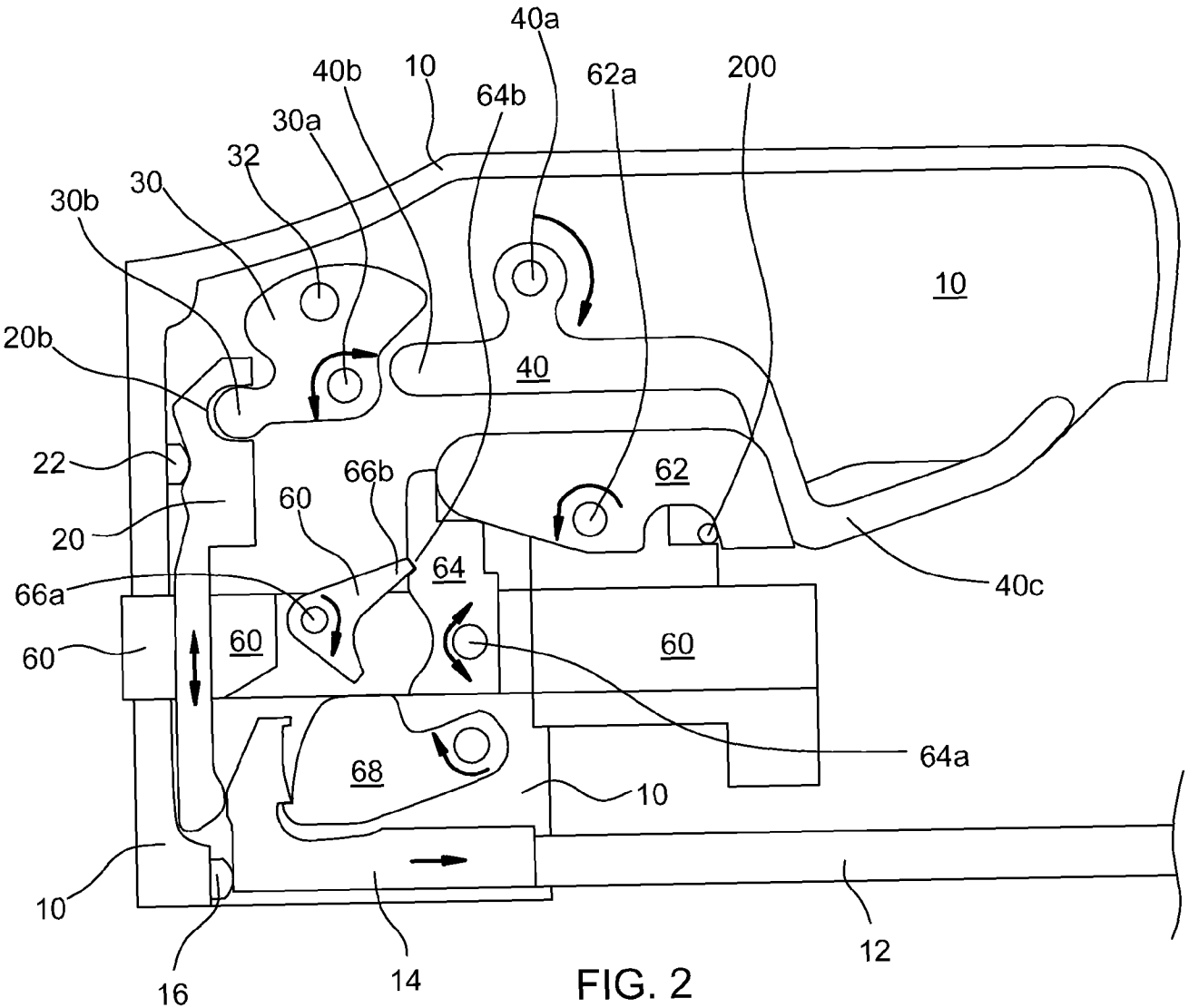
FIG. 2 is an enlarged schematic side view of the crossbow trigger assembly of FIG. 1 prior to placement of a bolt.

The trigger assembly is shown in FIG. 2 after the crossbow has been drawn but before a bolt (i.e., an arrow) has been loaded onto the crossbow for firing. Caliper 62 holds the bow string 200 in the drawn position. The caliper 62 is rotatably mounted on a carrier 60 which is in turn reciprocally moveable along the crossbow (not shown). A drawing mechanism of any suitable type (not shown) moves the carrier backward along the crossbow (to the left in the Figures) to draw the crossbow. The caliper 62 is directly biased to rotate upward (i.e., toward its firing position) about its axis 62*a* and release the bowstring 200 from behind a pair of forward projections of the caliper 62. Trigger sear 64 and fail-safe jam 66 are also rotatably mounted on the carrier 60 and rotate about respective axes 64*a* and 66*a*. Rotation of trigger sear 64 is not directly biased. Rotation of fail-safe jam 66 is directly biased downward (clockwise in the Figures).

Before the bow is drawn (not shown), bowstring 200 is positioned on the carrier 60 in front caliper 62 when the carrier 60 is at its rest position along the crossbow (i.e., undrawn, at the front end of its range of movement). An archer presses the front end of the caliper 62 downward (rotating it about its axis 62*a* clockwise in the Figures into its non-firing position) against its bias to retain bowstring 200 behind the forward projections of caliper 62. As the front of caliper 62 is forced downward by the archer, the bias of fail-safe jam 66 causes the fail-safe jam 66 to rotate downward (clockwise in the Figures) and to force trigger sear 64 to rotate upward (clockwise in the Figures) behind the back end of caliper 62. When the end 66*b* of fail-safe jam 66 engages the notch 64*b* of trigger sear 64, trigger sear 64 and fail-safe jam 66 together hold caliper 62 against its bias in position to retain the bowstring 200 (in a non-firing arrangement). An over-center arrangement of axis 64*a* and the contact point between trigger sear 64 and caliper 62 can also be employed to hold caliper 62 to retain the bowstring 200. The crossbow is drawn using the drawing mechanism to move the carrier 60 backward along the crossbow until it reaches the fully drawn position shown in the Figures. Although caliper 62, trigger sear 64, and fail-safe jam 66 are shown in the exemplary embodiment, any suitable structure, linkage, or mechanism can be employed as a string retainer to retain and release a bowstring; neither the present disclosure nor the appended claims are limited to the specific arrangement shown in the Figures.

Figure 1:
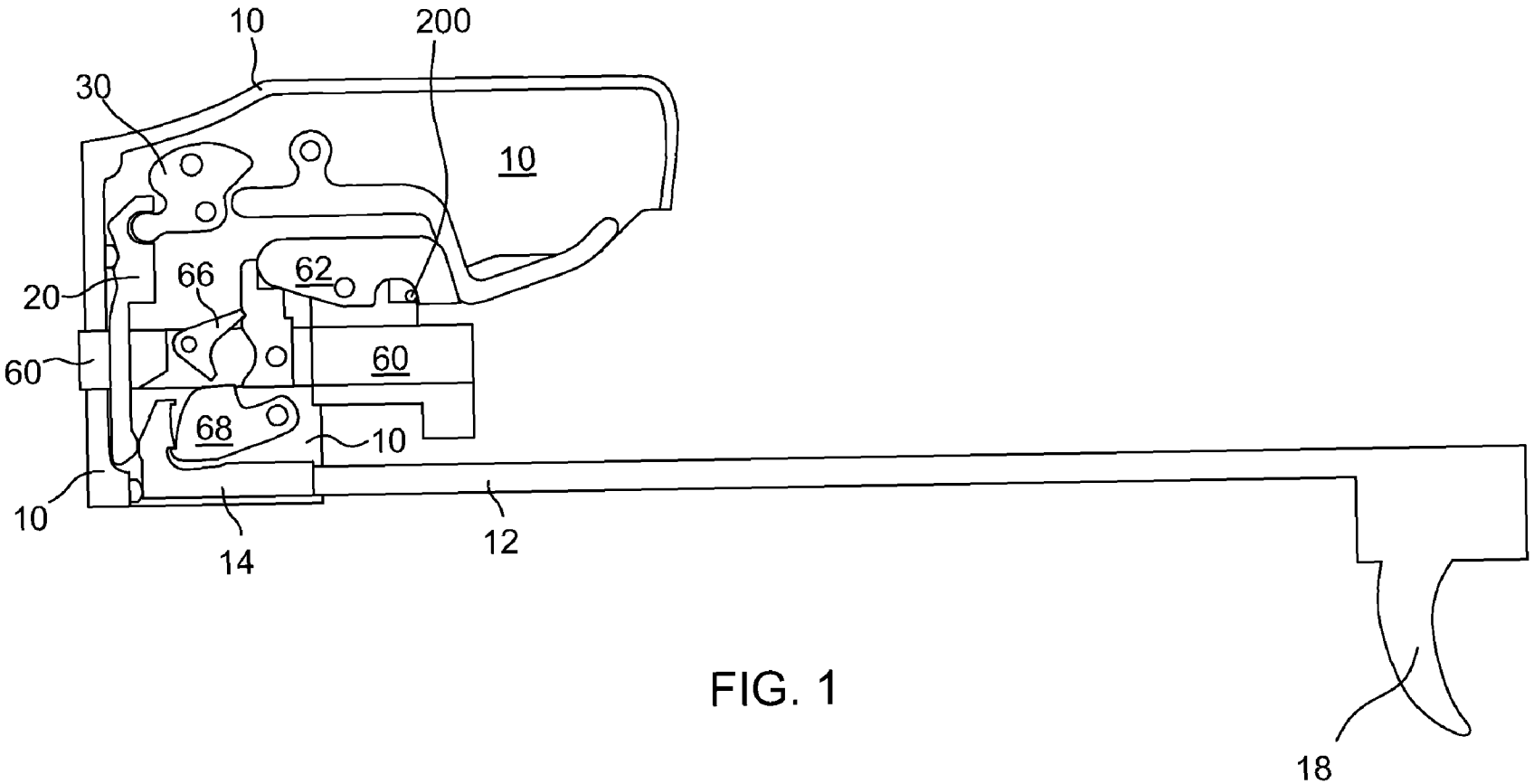
FIG. 1 is a schematic side view of a crossbow trigger assembly.

Safety slide 20 is shown blocking backward motion (i.e., motion to the left in the Figures) of sear 14, trigger rod 12, and trigger block 18 (trigger block 18 shown only in FIG. 1). Trigger bias 16 (a spring-loaded piston in this example; any suitable bias mechanism can be employed) urges the sear 14, trigger rod 12, and trigger block 18 forward (toward a non-firing arrangement). Although trigger rod 12 and trigger block 18 are shown in the exemplary embodiment, any suitable structure, linkage, or mechanism can be employed to couple a trigger to sear 14; neither the present disclosure nor the appended claims are limited to the specific arrangement shown in the Figures. A spring-loaded detent bias 22 is shown engaging one of two detents on safety slide 20 to hold it in this lower operational position (referred to as a "safety-on" arrangement or position), where it prevents triggering of the crossbow. The crossbow can only be fired if safety slide 20 moves upward to an upper operational position (referred to as its "firing" arrangement or position) where it does not block backward motion of the sear 14. Before the crossbow is drawn (not shown), safety latch 24 engages an edge 22*a* formed on the safety slide 20 (shown only in FIG. 7; omitted from the other Figures for clarity). The safety latch 24 can be formed from any suitable resilient material (e.g. spring steel) and its engagement with the edge 20*a* substantially prevents movement of safety slide 20 from its safety position. The trigger assembly is arranged so that upon ii fully drawing the crossbow, carrier 60 pushes the safety latch 24 backward so that it no longer engages the edge 20*a* on safety slide 20. The resilient material of safety latch 24 enables movement of carrier 60 to push it out of engagement with edge 20*a*, but enables the safety latch 24 to reestablish engagement with edge 20*a* when the carrier 60 moves forward again after firing the crossbow (described further hereinbelow).

Once the crossbow is drawn, the archer would push safety handle 32 forward to rotate the safety lever 30 forward (clockwise in the Figures) about its axis 30*a* and raise the safety slide 20 into its safety-off arrangement or position (through engagement or articulation of safety lever 30 and safety slide 20 by mating projection 30*b* and recess 20*b*; safety lever 30 and safety slide 20 together comprise a safety mechanism; any other suitable arrangement of mechanical members can be employed). However, the rear end 40*b* of bolt sensor 40 biases the rotation of safety lever 30 and movement of safety slide 20 toward a safety-on arrangement or position. Rotation of bolt sensor 40 about its axis 40*a* is biased so that its front end 40*c* is urged downward and its rear end 40*b* is positioned to bias the rotation of safety lever 30 toward its safety-on arrangement when no bolt is present (i.e., the bolt-absent position of bolt sensor 40). Without a bolt loaded onto the crossbow, the safety lever 30 can be moved into its safety-off position only with sufficient force applied to safety handle 32 to overcome the bias of the bolt sensor 40. This force is made sufficiently large (by the stiffness of the bolt sensor bias element and the short lever arm of the rear end 40*b* of bolt sensor 40) so that the archer will readily recognize that the crossbow is not loaded with a bolt and will have substantial difficulty moving the safety lever 30 into its safety-off position. Safety lever 30 and safety slide 20 therefore cannot be readily moved into the safety-off position unless a bolt is loaded onto the crossbow for firing, thereby reducing the likelihood of so-called "dry-firing" of the crossbow. Such dry firing can result in damage to the crossbow or injury to the archer.

Figure 3:
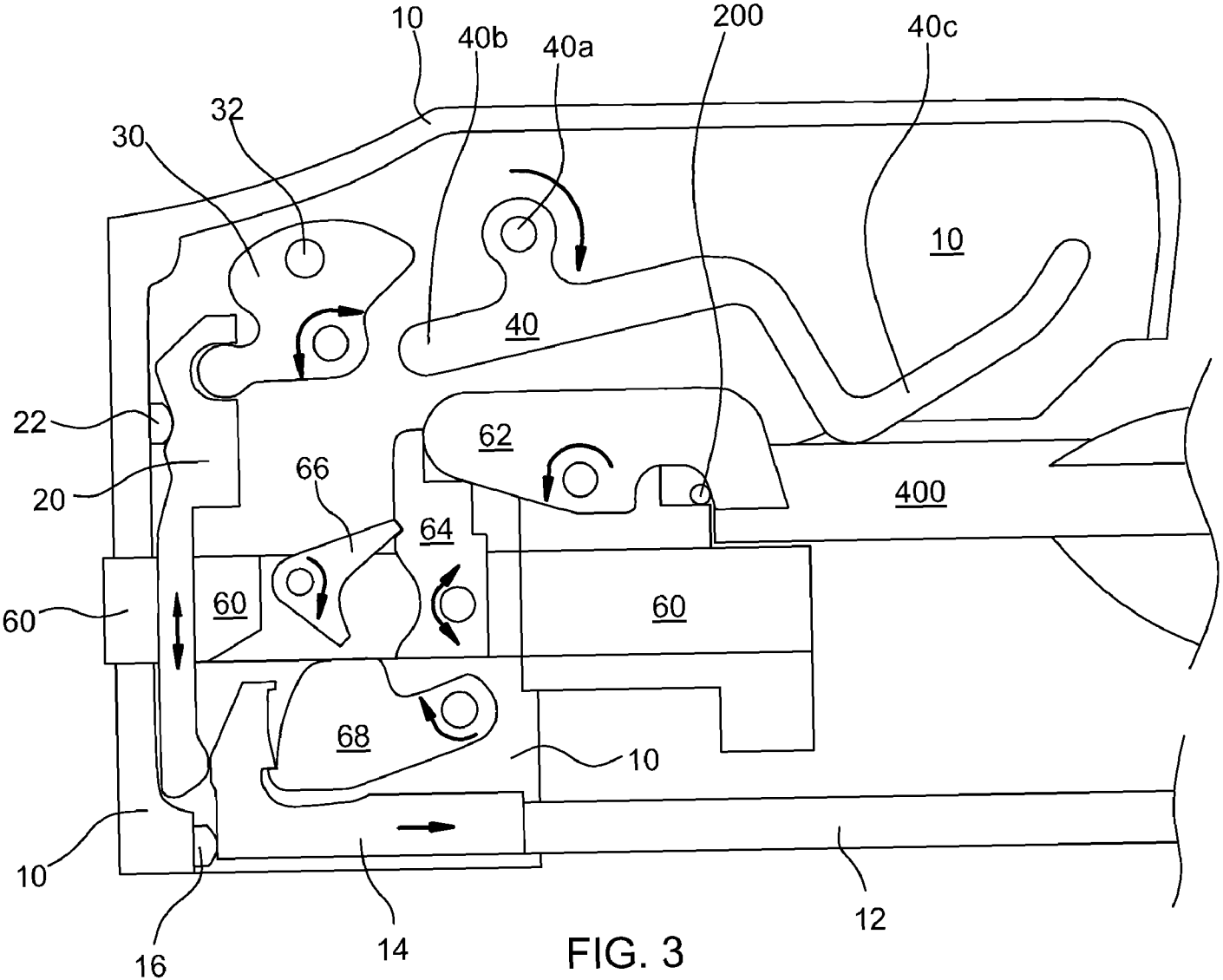
FIG. 3 is an enlarged schematic side view of the crossbow trigger assembly of FIG. 1 after placement of a bolt.
Figure 4:
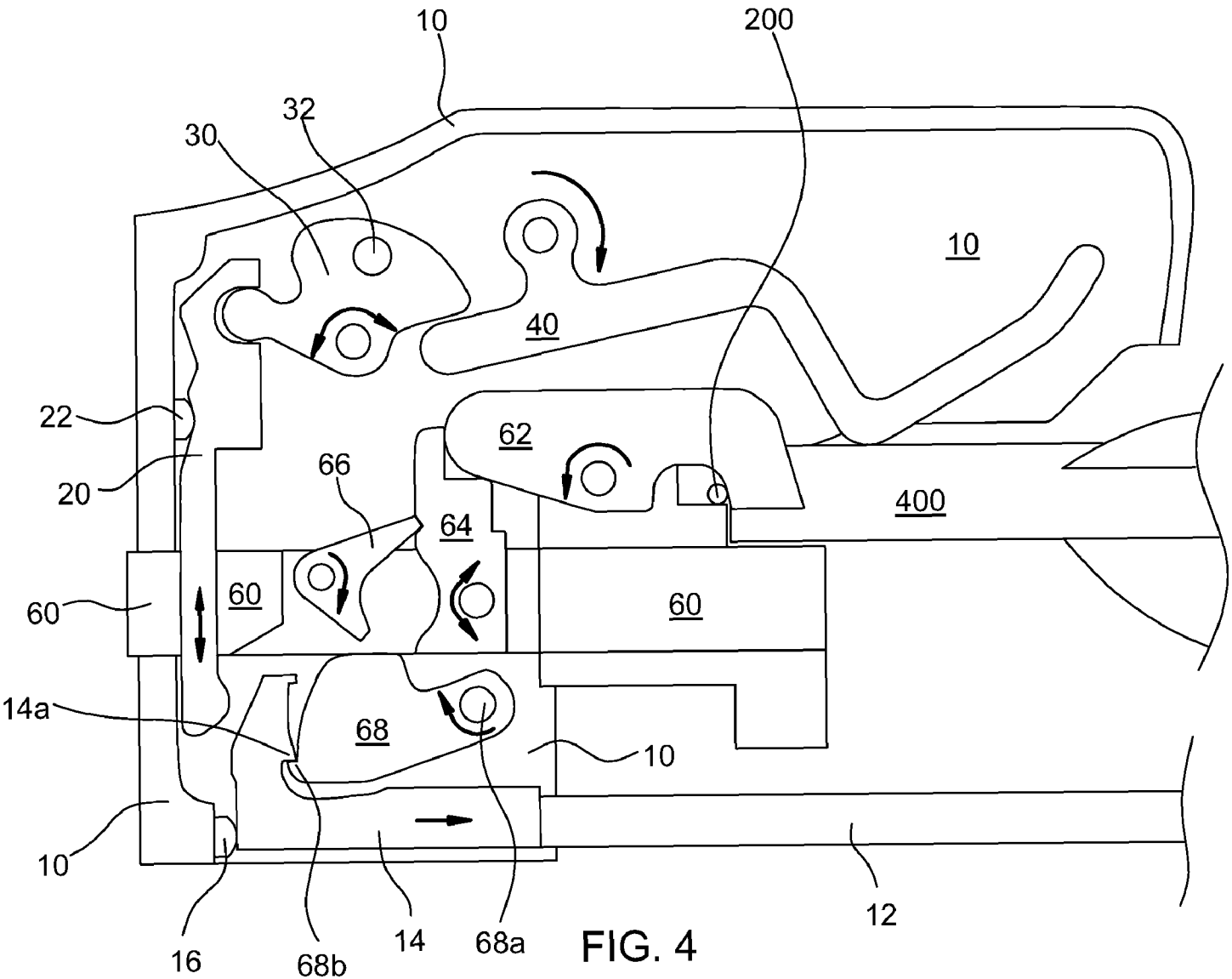
FIG. 4 is an enlarged schematic side view of the crossbow trigger assembly of FIG. 1 after releasing the safety.

In FIG. 3, a bolt 400 has been loaded onto the crossbow for firing. The nock end of the bolt is positioned against the bowstring 200 between the forward projections of caliper 62 and under the front end 40*c* of bolt sensor 40. The shaft of the bolt 400 forces the front end 40*c* of bolt sensor 40 upward, rotating it about its axis 40*a* (counter-clockwise in the Figures, to its bolt-present position) and causing its rear end 40*b* to move downward, where it does not bias the rotation of safety lever 30. The rotation of bolt sensor 40 into this bolt-present position therefore enables unbiased rotation of safety lever 30. Although bolt sensor 40 is shown in the exemplary embodiment, any suitable structure, linkage, or mechanism can be employed as a bolt sensor to bias the safety mechanism in a bolt-absent arrangement and allow unbiased movement of the safety mechanism in a bolt-present arrangement; neither the present disclosure nor the appended claims are limited to the specific arrangement shown in the Figures. While safety lever 30 is in its safety-on position, safety slide 20 blocks backward movement of sear 14 and therefore prevents accidental firing of the crossbow. When ready to fire and with bolt 400 loaded onto the crossbow, the archer can move safety handle 32 forward to rotate safety lever 30 into its safety-off position (FIG. 4), which also causes safety slide 20 to move upward into its safety-off position. In the safety-off position, the detent bias 22 engages the other detent on safety slide 20, and the safety slide 20 no longer blocks backward movement of the sear 14 (FIG. 4). The crossbow trigger assembly is ready for firing.

It should be noted that at this stage (FIG. 4, bolt loaded, safety off, and ready for firing), removal of bolt 400 from the crossbow results in reengagement of the safety mechanism. If bolt 400 is removed (and its presence no longer prevents downward movement of the front end 40*c* of bolt sensor 40), the bias on bolt sensor 40 causes it to rotate clockwise, and its rear end 40*b* biases safety lever 30 to rotate counterclockwise and force safety slide 20 downward into its safety-on position, where it blocks backward motion of sear 14.

Figure 5:
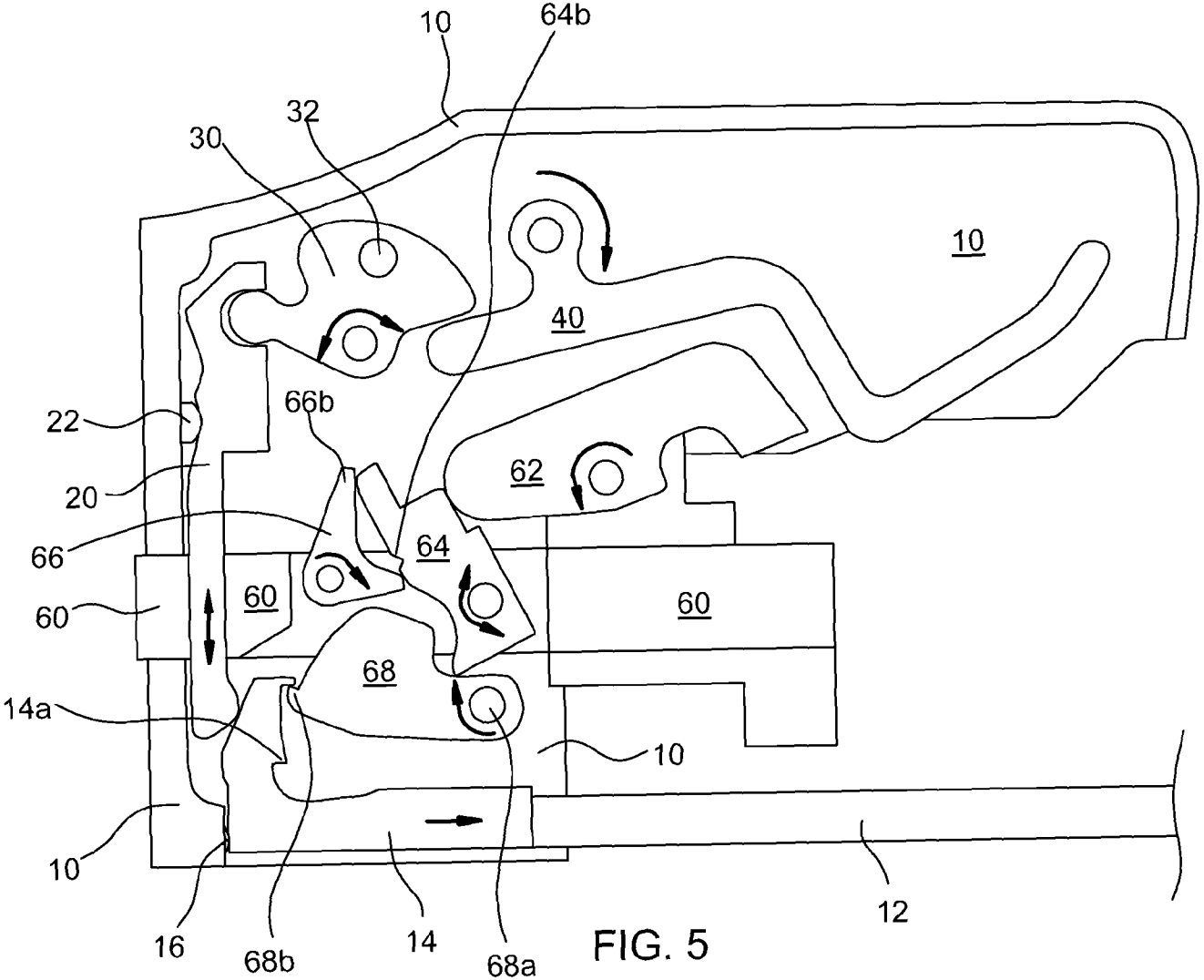
FIG. 5 is an enlarged schematic side view of the crossbow trigger assembly of FIG. 1 after triggering the crossbow.
Figure 6:
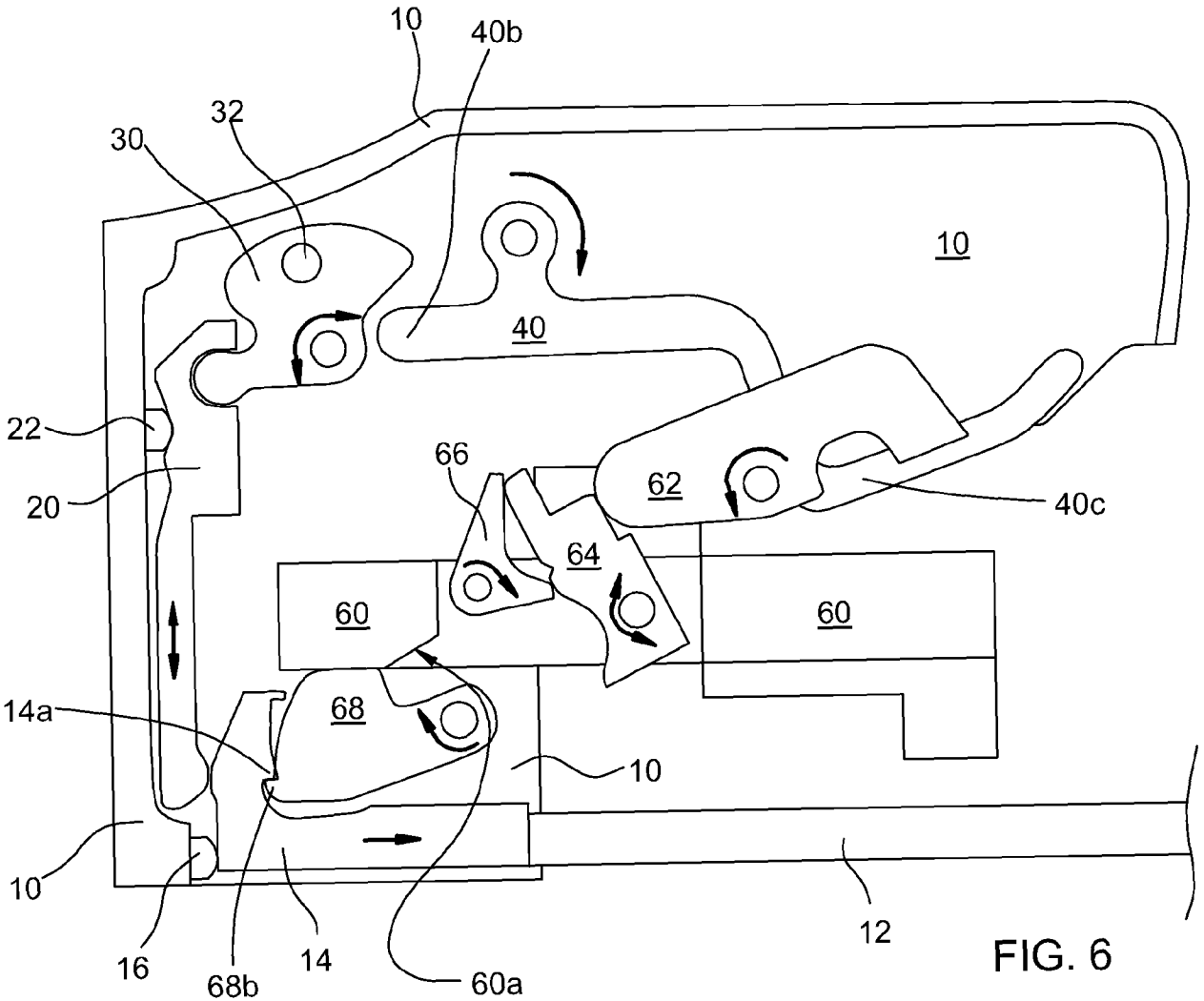
FIG. 6 is an enlarged schematic side view of the crossbow trigger assembly of FIG. 1 during resetting of the crossbow.

FIG. 5 shows the trigger assembly after firing the crossbow. Sear 14, hammer 68, trigger sear 64, and fail-safe jam 66 together comprise a trigger mechanism; any other suitable arrangement of mechanical members can be employed, and neither the present disclosure nor the appended claims are limited to the specific arrangement shown in the Figures. Prior to firing (FIG. 4), the engaged surfaces 14*a* and 68*b* of the sear 14 and hammer 68, respectively, prevent upward movement of the hammer 68 under the influence of its direct bias. When the archer pulls the trigger, trigger block 18, trigger rod 12, and sear 14 all move backward against trigger bias 16. This motion of sear 14 results in disengagement of surfaces 14*a* and 68*b* and allows hammer 68 to spring upward, rotating about its axis 68*a* propelled by its bias force. Impact of the hammer 68 on the fail-safe jam 66 causes the fail-safe jam 66 to rotate upward against its bias force (counter-clockwise in the Figures) sufficiently to disengage its end 66*b* from notch 64*b*. With fail-safe jam 66 no longer holding trigger sear 64 in place, and in the absence of an over-center arrangement of axis 64*a* and the contact point between trigger sear 64 and caliper 62, caliper 62 and trigger sear 64 both rotate backwards (counter-clockwise in the Figures) under the impetus of the bias force on caliper 62. The movement of caliper 62 releases the bowstring 200 and fires the bolt 400 (both missing from FIG. 5 since the crossbow has been fired). If there is an over-center arrangement of axis 64*a* and the contact point between trigger sear 64 and caliper 62, then impact of the hammer 68 on the lower portion of trigger sear 64 initiates backward movement of trigger sear 64 after disengagement of fail-safe jam 66 from notch 64*b*. Caliper 62 and trigger sear 64 both continue to rotate backwards (counter-clockwise in the Figures) under the impetus of the bias force on caliper 62.

Once the crossbow has been fired but before the carrier 60 is moved forward to prepare for the next shot (FIG. 5), sear 14 is held in position against trigger bias 16 by engagement with hammer 68. This rearward position of sear 14 prevents movement of safety slide 20 back down into its safety position, rotation of safety lever 30 to its safety position, and rotation of bolt sensor 40 to its bolt-absent position. As the crossbow drawing mechanism begins to move carrier 60 forward in preparation for the next shot (FIG. 6), angled surface 60*a* of carrier 60 forces hammer 68 downward against its bias force. When hammer 68 has been moved far enough downward, surfaces 14*a* and 68*b* re-engage and trigger bias 16 moves sear 14, trigger rod 12, and trigger block 18 forward. This in turn allows the bias force on bolt sensor 40 to rotate its front end 40*c* downward and its rear end 40*b* upward (clockwise in the Figures) into its bolt-absent position, in turn rotating safety lever 30 upward into its safety position (counter-clockwise in the Figures) and moving safety slide 20 downward into its safety position, where it blocks rearward movement of sear 14. The forward movement of carrier 60 also enables safety latch 24 to move forward and re-engage edge 20*a* of safety slide 20 when it returns to its safety position. Once the carrier is moved all the way forward by ii the drawing mechanism, the crossbow is ready to be drawn again and loaded for the next shot.

Although specific arrangements are shown in the exemplary embodiment, any suitable structures, linkages, or mechanisms can be employed to perform the function recited herein; neither the present disclosure nor the appended claims are limited to the specific arrangements or embodiments shown in the Figures. It is intended that equivalents of the disclosed exemplary embodiments and methods shall fall within the scope of the present disclosure or appended claims. For example, parts that are shown in the exemplary embodiment as rotating can move linearly in alternative embodiments, and vice versa. It is intended that the disclosed exemplary embodiments and methods, and equivalents thereof, may be modified while remaining within the scope of the present disclosure or appended claims.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" and "a dog or a cat or a mouse" would each be interpreted as "a dog, or a cat, or a mouse, or any two, or all three"), unless: (i) it is explicitly stated otherwise, e.g., by use of "either . . . or", "only one of . . . ", or similar language; or (ii) two or more of the listed alternatives are mutually exclusive within the particular context, in which case "or" would encompass only those combinations involving non-mutually-exclusive alternatives. For purposes of the present disclosure or appended claims, the words "comprising", "including", and "having" shall be construed as open ended terminology, with the same meaning as if the phrase "at least" were appended after each instance thereof.

What is claimed is:

1. A trigger assembly for a crossbow, the trigger assembly comprising:

(a) a caliper moveable between a firing position and a non-firing position, the caliper being arranged in its non-firing position to retain a bowstring of the crossbow and arranged in its firing position to release the bowstring;

(b) a trigger mechanism moveable between a firing arrangement and a non-firing arrangement, the trigger mechanism being arranged in its non-firing arrangement to hold the caliper in its non-firing position, and arranged in its firing arrangement to enable the caliper to move to its firing position;

(c) a safety mechanism moveable between a safety-off arrangement and a safety-on arrangement, the safety mechanism being arranged in its safety-on arrangement so as to block movement of the trigger mechanism into its firing arrangement, and arranged in its safety-off arrangement so as to allow movement of the trigger mechanism into its firing arrangement; and (d) a bolt sensor moveable between a bolt-present position and a bolt-absent position and biased toward the bolt-absent position, the bolt sensor being arranged to remain in its bolt-absent position in response to its bias in the absence of a bolt loaded onto the crossbow and to be held in its bolt-present position against its bias by a bolt loaded onto the crossbow, the bolt sensor being arranged in its bolt-absent position to bias the safety mechanism toward its safety-on arrangement and arranged in its bolt-present position to allow unbiased movement of the safety mechanism into its safety-off arrangement.

2. The trigger assembly of claim 1 wherein the caliper is biased toward the firing position, the trigger mechanism is arranged in its non-firing arrangement to hold the caliper in its non-firing position against its bias, and arranged in its firing arrangement to enable the caliper to move in response to its bias to its firing position.

3. The trigger assembly of claim 1 wherein trigger assembly is biased toward its non-firing position.

4. The trigger assembly of claim 1 wherein the safety mechanism comprises a rotating safety lever and a reciprocating safety slide engaged therewith, the safety slide is arranged to block movement of the trigger mechanism into its firing arrangement with the safety mechanism in its safety-on position, and the bolt sensor is arranged to bias the safety lever toward the safety-on arrangement of the safety mechanism with the bolt sensor in its bolt-absent position.

5. The trigger assembly of claim 4 further comprising a safety handle secured to the safety lever.

6. The trigger assembly of claim 4 wherein the safety lever includes a projection thereof received within a corresponding recess in the safety slide.

7. The trigger assembly of claim 4 further comprising a detent mechanism for retaining the safety slide in the safety-on arrangement or the safety-off arrangement of the safety mechanism.

8. The trigger assembly of claim 1 wherein the caliper is mounted on a carrier reciprocally moveable along the crossbow between a drawn position and a rest position, the trigger assembly further comprising a safety latch arranged to block movement of the safety mechanism to its safety-off arrangement unless the carrier is in its drawn position, and arranged to enable movement of the safety mechanism to its safety-off arrangement with the carrier in its drawn position.

9. The trigger assembly of claim 8 wherein the safety latch comprises a resilient member engaged with the safety mechanism and arranged to block movement of the safety mechanism to its safety-off position unless the carrier is in its drawn position, and the carrier in its drawn position is arranged to bias the resilient member thereby disengaging it from the safety mechanism.

10. The trigger assembly of claim 1 wherein the caliper is mounted on a carrier reciprocally moveable along the crossbow between a drawn position and a rest position, and the carrier is arranged to move the trigger mechanism to its non-firing arrangement as the carrier moves from its drawn position to its rest position.

11. A trigger assembly for a crossbow, the trigger assembly comprising:

(a) a sear moveable between a firing position and a non-firing position and biased toward the non-firing position;

(b) a hammer moveable between a firing position and a non-firing position and biased toward the firing position;

(c) a safety mechanism moveable between a safety-on arrangement and a safety-off arrangement;

(d) a bolt sensor moveable between a bolt-absent position and a bolt-present position and biased toward the bolt-absent position;

(e) a jam moveable between a firing position and a non-firing position and biased toward the non-firing position;

(f) a trigger sear moveable between a firing position and a non-firing position; and (g) a caliper mounted on a carrier reciprocally moveable along the crossbow between a drawn position and a rest position, the caliper being moveable between a firing position and a non-firing position and biased toward the firing position, wherein:

the jam and the trigger sear are mounted on the carrier;

the caliper is arranged in its non-firing position to retain a bowstring of the crossbow, and arranged in its firing position to release the bowstring;

the jam and the trigger sear are arranged and engaged in their respective non-firing positions to hold the caliper in its non-firing position against its bias, and arranged in their respective firing positions to enable the caliper to move in response to its bias to its firing position;

the hammer is arranged, with the carrier in its drawn position, to hit the jam as the hammer moves from its non-firing position to its firing position to disengage the jam from the trigger sear, thereby enabling the jam and trigger sear to move to their respective firing positions in response to the caliper bias;

the sear is arranged in its non-firing position to hold the hammer in its non-firing position against its bias, and arranged in its firing position to enable the hammer to move to its firing position in response to its bias;

the safety mechanism is arranged in its safety-on arrangement to block movement of the sear to its firing position, and arranged in its safety-off arrangement to enable movement of the sear to its firing position;

the bolt sensor is arranged in its bolt-absent position to bias the safety mechanism toward its safety-on arrangement, and arranged in its bolt-present position to enable unbiased movement of the safety mechanism to its safety-off arrangement; and the bolt sensor is arranged to remain in its bolt-absent position in response to its bias in the absence of a bolt loaded onto the crossbow, and arranged to be held in its bolt-present position against its bias by a bolt loaded onto the crossbow.

12. The trigger assembly of claim 11 wherein the safety mechanism comprises a rotating safety lever and a reciprocating safety slide engaged therewith, the safety slide is arranged to block movement of the sear with the safety mechanism in its safety-on arrangement, and the bolt sensor is arranged, in its bolt-absent position, to bias the safety lever toward the safety-on arrangement of the safety mechanism.

13. The trigger assembly of claim 12 further comprising a safety handle secured to the safety lever.

14. The trigger assembly of claim 12 wherein the safety lever includes a projection thereof received within a corresponding recess in the safety slide.

15. The trigger assembly of claim 12 further comprising a detent mechanism for retaining the safety slide in the safety-on arrangement or the safety-off arrangement of the safety mechanism.

16. The trigger assembly of claim 11 further comprising a safety latch arranged to block movement of the safety mechanism to its safety-off arrangement unless the carrier is in its drawn position, and arranged to enable movement of the safety mechanism to its safety-off position with the carrier in its drawn position.

17. The trigger assembly of claim 16 wherein the safety latch comprises a resilient member engaged with the safety mechanism and arranged to block movement of the safety mechanism to its safety-off arrangement unless the carrier is in its drawn position, and the carrier in its drawn position is arranged to bias the resilient member thereby disengaging it from the safety mechanism.

18. The trigger assembly of claim 11 wherein the hammer is arranged to be moved against its bias to its non-firing position as the carrier moves from its drawn position to its rest position.

19. The trigger assembly of claim 18 wherein the carrier has formed thereon a sloped portion of its lower surface that engages the hammer and moves it to its non-firing position.

20. The trigger assembly of claim 11 wherein an end of the jam received in a notch on the trigger sear provides engagement thereof in their respective non-firing positions.

21. A trigger assembly for a crossbow, the trigger assembly comprising:

a string retainer movable between a non-firing arrangement and a firing arrangement, the string retainer being arranged in its non-firing arrangement to retain a bowstring of the crossbow and arranged in its firing arrangement to release the bowstring;

a trigger mechanism moveable between a firing arrangement and a non-firing arrangement, the trigger mechanism being arranged in its non-firing arrangement to maintain the string retainer in its non-firing arrangement, the trigger mechanism being arranged in its firing arrangement to allow the string retainer to move to its firing arrangement;

a safety mechanism moveable between a safety-off arrangement and a safety-on arrangement, the safety mechanism being arranged in its safety-on arrangement so as to block movement of the trigger mechanism into its firing arrangement, the safety mechanism being arranged in its safety-off arrangement so as to allow movement of the trigger mechanism into its firing arrangement; and a bolt sensor moveable between a bolt-absent arrangement and a bolt-present arrangement and biased toward the bolt-absent arrangement, the bolt sensor being arranged in its bolt-absent arrangement to bias the safety mechanism toward its safety-on arrangement, the bolt sensor being arranged in its bolt-present arrangement to allow movement of the safety mechanism to its safety-off arrangement, the bolt sensor being arranged (i) to remain in its bolt-absent arrangement in response to its bias in the absence of a bolt loaded onto the crossbow, (ii) to move against its bias to its bolt-present arrangement upon loading of a bolt onto the crossbow, (iii) to be held against its bias in its bolt-present arrangement by a bolt loaded into the crossbow, and (iv) to move in response to its bias to its bolt-absent position upon removal of a loaded bolt from the crossbow.

* * * * *